United States Patent [19]

Chadwick et al.

[11] 3,969,721

[45] July 13, 1976

[54] LIGHT EMITTING DIODE INDICATOR ASSEMBLY FOR A MULTIPLE PUSHBUTTON ARRAY

[75] Inventors: Donald Thornton Chadwick, Ottawa; Gerd Kuhfus, London, both of Canada

[73] Assignee: Northern Electric Company Limited, Montreal, Canada

[22] Filed: Nov. 10, 1975

[21] Appl. No.: 630,159

[52] U.S. Cl. ..... 340/381; 340/366 E; 200/317

[51] Int. Cl.[2] ..... G09F 3/14; H01H 3/12

[58] Field of Search ..... 340/381, 366 R, 366 G, 340/366 E, 378 R, 383, 337, 336, 324 R; 200/308, 310, 312, 313, 314, 317; 116/124 L

[56] References Cited

UNITED STATES PATENTS 3,811,025 5/1974 Bach ..... 200/317

*Primary Examiner*—John W. Caldwell
*Assistant Examiner*—William M. Wannisky
*Attorney, Agent, or Firm*—Sidney T. Jelly

[57] ABSTRACT

A light emitting diode indicator assembly for a multiple pushbutton array has a printed circuit board with a plurality of circuits thereon, each circuit having a connection position for a light emitting diode; a spacer attached to the printed circuit board with a location for a light emitting diode coincident with a related connection position; a light emitting diode at each location with leads connected to the related circuit; a lens over each diode; and a bezel having a first row of apertures with a lens situated in each aperture, and a second row of apertures with a pushbutton in each aperture, the bezel and spacer having interengaging formations whereby the spacer is inserted into a recess in the bezel and the formations engaged by lateral movement of the spacer relative to the bezel. There can be more than one row of lens containing apertures, and also more than one row of pushbuttons containing apertures.

5 Claims, 17 Drawing Figures

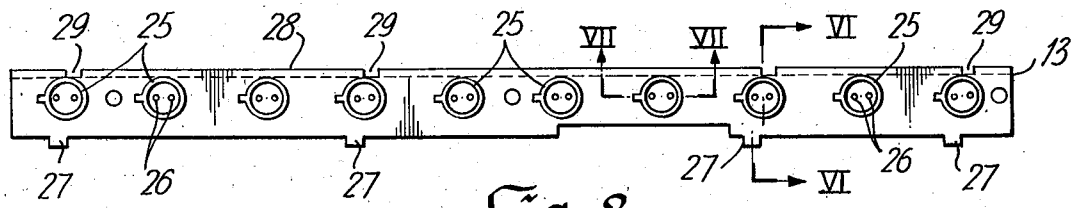
Fig. 3
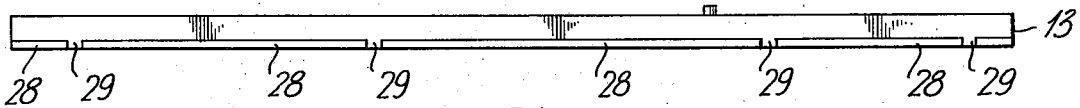
Fig. 4
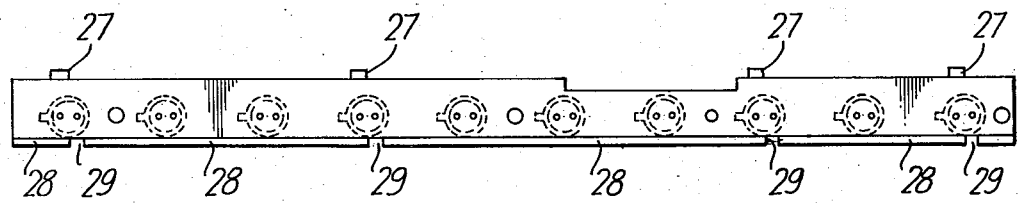
Fig. 5
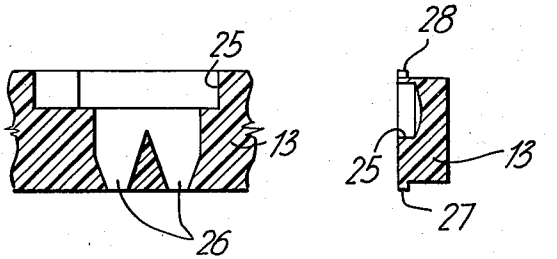
Fig. 7
Fig. 6
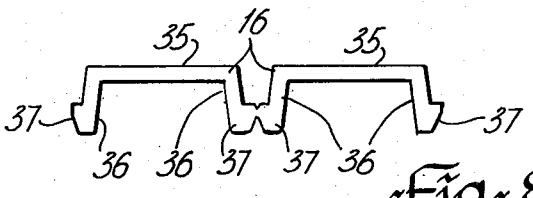
Fig. 8
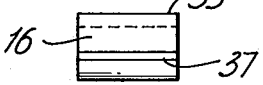
Fig. 9

XVI
XVII
1
2
3
4
5
6
7
8
9
18
19
40
41
42
43
45
46
53

LIGHT EMITTING DIODE INDICATOR ASSEMBLY FOR A MULTIPLE PUSHBUTTON ARRAY

This invention relates to light emitting diode indicator assemblies for multiple pushbutton arrays and particularly with such arrays in which the function of a pushbutton is likely to change frequently.

Pushbuttons, with associated illuminated indicators, are used in various items, for example telephone units and terminus units for communications systems and the like. The particular size, function and usage of such items varies considerably and the number of pushbuttons, or keys will also vary.

Depending upon the particular use, the designation given by an indicator may require to be changed frequently, for example in a business communications system which is electronic in action and using programme software which can be altered rapidly as desired. With such a system it is likely that certain buttons or keys, should not have an associated light emitting diode actuated.

The present invention provides a light emitting diode (LED) indicator assembly for a multiple pushbutton array which is attractive; easy and economic to produce; is quickly and easily assembled and yet provides easy and quick change of illumination characteristics.

Thus the invention provides a light emitting diode assembly which includes an elongate printed circuit board having a plurality of circuits thereon and a plurality of connection positions for connection of LEDs to the circuits, an elongate insulating spacer attached to the circuit board and having a plurality of locations of LEDs, each location associated with a connection position, an LED at each location with the leads connected to the related circuit, a lens positioned over each LED, and a bezel having a row of apertures with a lens in each aperture and a second row of apertures for reception of a push button key in each aperture, the push button key in lateral alignment with a lens to correlate with an LED, the bezel and spacer having interengaging formations whereby the spacer is inserted into a recess in the bezel and moved longitudinally to engage the interengaging formations.

More than one row of LEDs, and related lenses and apertures may be provided.

The invention will be readily understood by the following description of certain embodiments, by way of example, in conjunction with the accompanying drawings, in which.

Figure 12:
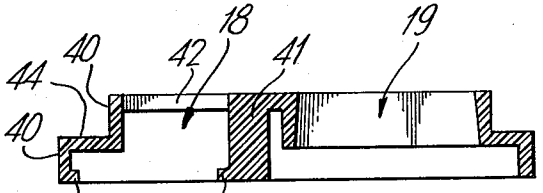
Figure 13:
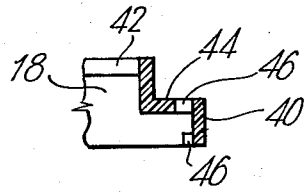
Figure 10:
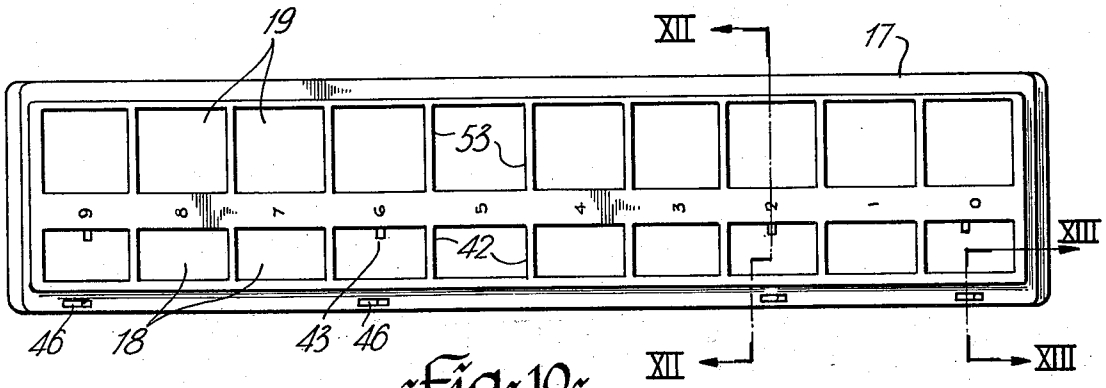
Figure 11:
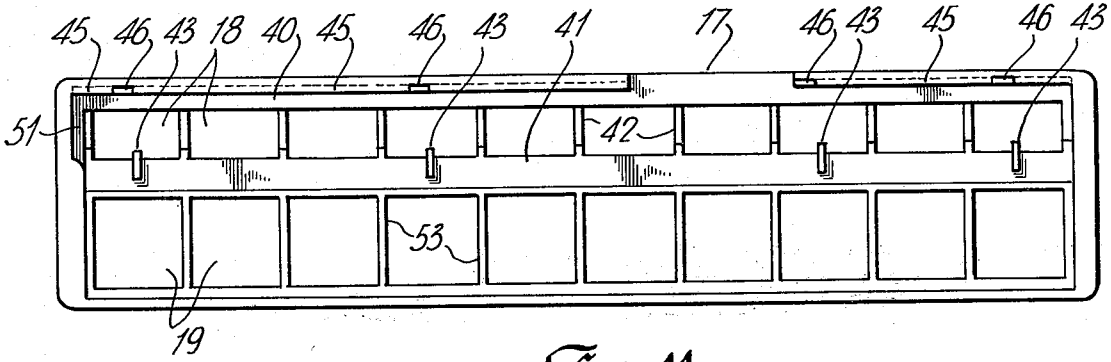
Figures 14, 15, 16, 17:
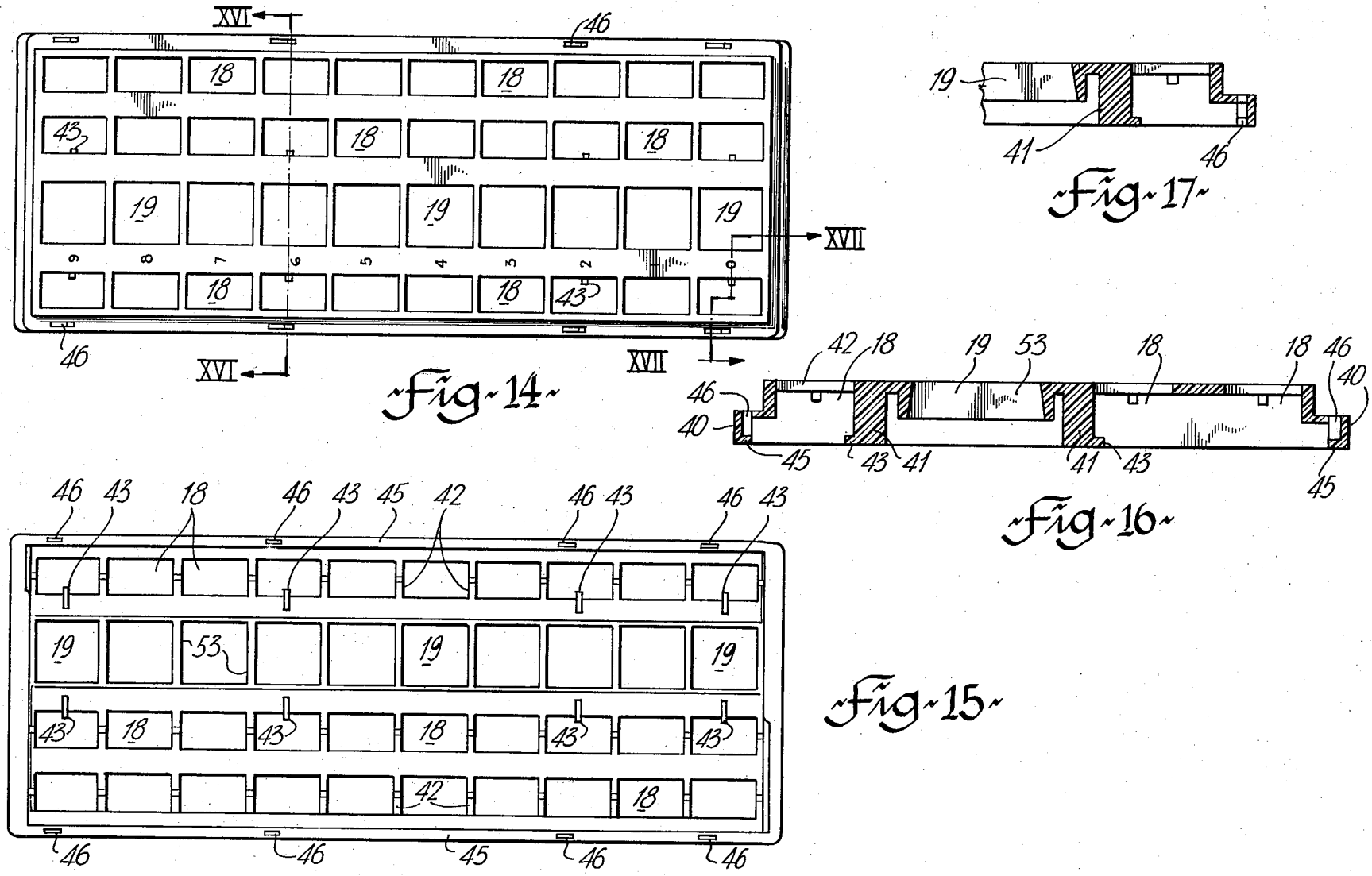

FIGS. 3, 4 and 5 and top plan, side and bottom plan views of a spacer;

FIGS. 6 and 7 are cross-sections on the lines VI—VI and VII—VII of FIG. 3;

FIGS. 8 and 9 are side and end views of a lens structure; to a larger scale;

FIGS. 10 and 11 are top and bottom plan views of a frame or bezel;

FIGS. 12 and 13 are cross-sections on lines XII—XII and XIII—XIII of FIG. 10;

FIGS. 14 and 15 are top and bottom plan views of a further form of bezel;

FIGS. 16 and 17 are cross-sections on lines XVI—XVI and XVII—XVII of FIG. 14.

Figure 1:
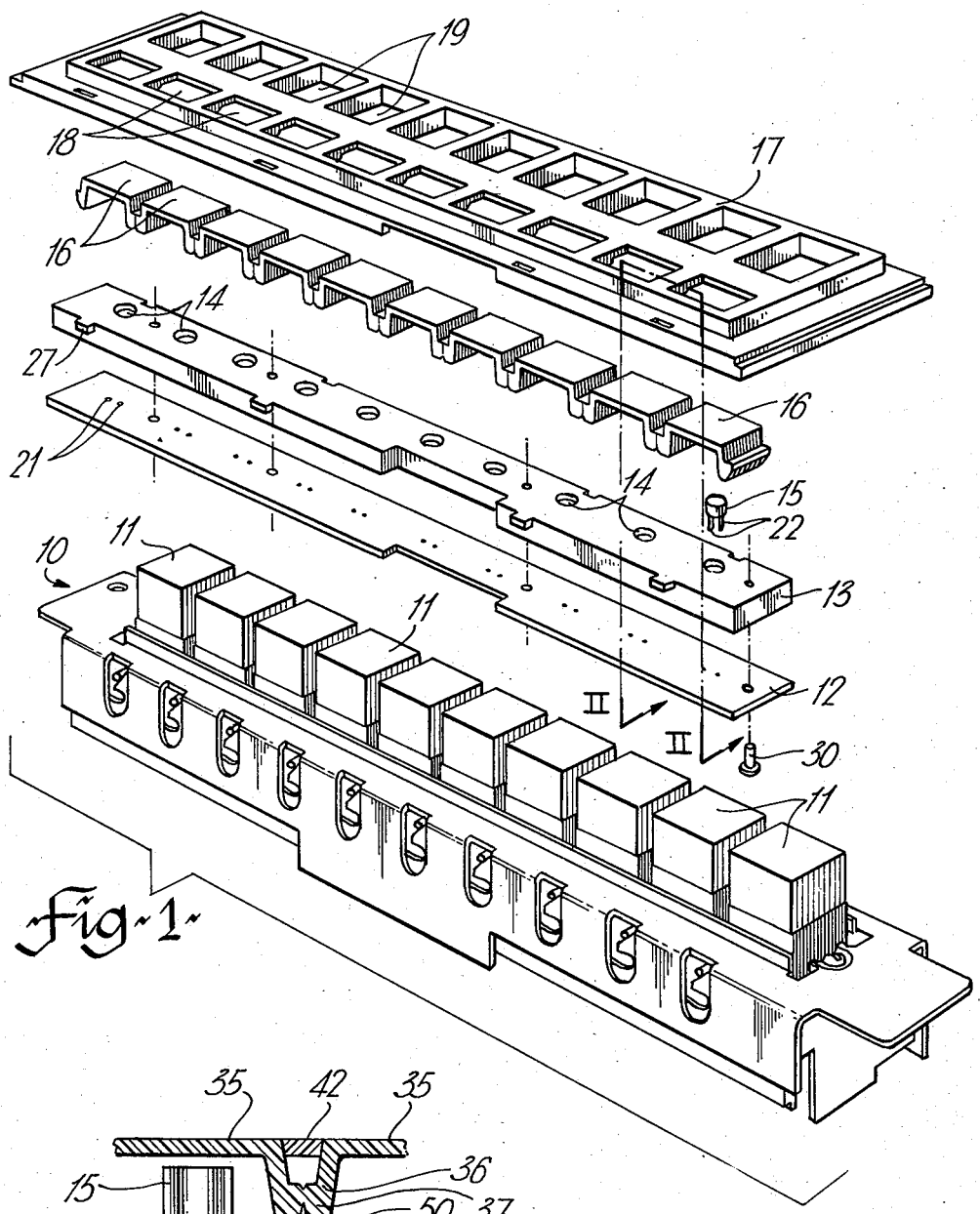
FIG. 1 is an exploded view of one multiple pushbutton array with a light emitting diode indicator assembly.

As illustrated in FIG. 1 a pushbutton array 10 has a plurality of pushbuttons, or keys 11. The array 10 is of well known form and the buttons 11 may be locking or non-locking, as desired. To provide an illuminated indicator for each button 11, an assembly comprising a printed circuit board (PCB) 12, a spacer 13 which also has a series of locations 14 for light emitting diodes (LED) 15, a plurality of lenses 16 and a bezel or collar 17. The assembly of PCB 12, spacer 13, LEDs 15, and lenses 16 attaches to the bezel 17 such that the lenses 16 fit into one series of apertures 18 in the bezel 17, while the pushbuttons 11 project through another series of apertures 19 in the bezel 17. A pushbutton 11 is positioned alongside a lens 16.

Figure 2:
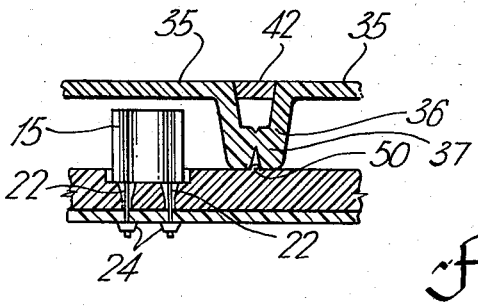
FIG. 2 is a cross-section on the line II—II of FIG. 1.

The printed circuit board 12 is of elongate conventional form, that is a sheet of insulating material, for example synthetic resin impregnated glass fibre, on which an electrical circuit, indicated at 20 in FIG. 2, is produced. Small holes 21 through the PCB 12, and arranged in pairs, admit leads 22 of LEDs 15 and the leads 22 are wave soldered to the appropriate connection positions on the circuit 20, as indicated at 24.

The spacer 13 is of molded construction of electrically insulative material, and is seen in more detail in FIGS. 3, 4, 5 and 6. FIG. 3 is a top plan view and as shown, the spacer 13 also is of elongate form, having a series of recesses 25, for reception of the LEDs 15. At the bottoms of the recesses 25 are pairs of holes 26 through which pass the leads 22 of the LEDs. The spacer has a number of projections 27 along one side and a thin web or flange 28 extends along the other side at its top edge. The web or flange 28 has a number of notches or slots 29 therein.

The holes 26 in the bottom of each recess 25, are tapered, as seen in FIG. 7. This tapered form assists in ensuring that each lead 22 of an LED 15 correctly enters its particular hole 26, and thence through the appropriate hole 21 in the PCB 12. The spacer 13 and PCB 12 are assembled together, as by rivets 30. The LEDs 15 are then inserted into recesses 25, the leads 22 passing through the spacer 13 and PCB 12, and then wave soldered to the circuit 20. Other ways of joining the spacer and PCB can be used, for example heat staking, in which small protrusions are formed on the undersurface of the spacer, or top surface of the PCB, and the two members pressed together while heated. The protrusions soften and bond the two parts together.

The lenses 16 are molded in pairs. There are various reasons for this. Firstly, if the lenses are molded in a long strip it becomes difficult to control the cumulative tolerance differences between lens strips and the bezel. Secondly, as will be described later, it is necessary to provide for the facility of altering a lens to blank out an LED. At the same time, for economy, it is desirable to produce more than one lens as a unit. As a compromise, the lenses 16 are produced in pairs, but this is not essential and could be produced singly, or in threes or fours for example.

Each lens has a top surface 35, and two downwardly projecting webs 36. At the bottom of each web 36 is an outwardly extending projection 37. Each lens is of a size and shape that it fits into a corresponding aperture 18 in the bezel 17. The outer surfaces of the webs 36 are slightly inclined — primarily to provide mold draft for molding. However this provides a convenient slight wedging action when the lenses are inserted into the apertures 18 and the lenses are thus held in place prior to assembly of the spacer and PCB to the bezel without additional retaining means.

The bezel 17, as illustrated in FIG. 1, and in more detail in FIGS. 10, 11 and 12, is a plastic molding with two rows of apertures 18 and 19. Apertures 18 receive the lenses 16 and apertures 19 receive the pushbuttons 11.

Insofar as the apertures 19 are concerned, as can be seen in FIG. 12, these are tapered slightly, downwardly and outwardly and are a clearance fit over the pushbuttons 11, providing easy and free movement of the pushbuttons. The apertures 18, and the formation of the bezel structure immediately adjacent to the apertures 18, is of particular concern as it is intended to provide cooperative engagement with the spacer 13 for assembly of PCB 12, spacer 13, and lenses 16 to the bezel 17, for eventual attachment to the pushbutton array 10.

Considering the formation of the bezel structure associated with the apertures 18, and considering particularly FIGS. 11, 12 and 13, the apertures exist individually only at the level of the top of the bezel, being defined by side wall 40, and intermediate web 41 extending longitudinally of the bezel and cross bars 42 joining the side wall 40 and web 41. Web 41 extends the thickness of the bezel, and at its lower end has a number of inwardly projecting protrusions 43. The positioning and spacing of the protrusions is such that they will pass through the slots 29 in the flange 28 of the spacer 13.

The side wall 40 extends downwardly for approximately half the thickness of the bezel — this distance being approximately the distance between the top surface 35 of the lenses 16 and the tops of the projections 37. The side wall 40 then extends or projects laterally — at 44 — and then downwards again. At the lower end of the side wall 40 there is an inwardly extending flange 45 having a number of slots 46 therein. The positioning and spacing of the slots 46 is such that the projections 27 on the spacer 13 will pass through the slots 46.

The distance between the lower part of the side wall 40 and the lower part of the web 41 is approximately the width of the spacer 13, and the distance between the lower surface of the lateral extension 44 of the side wall 40 and the upper surface of the flange 45 — and protrusions 43 — is approximately equal to the thickness of the projections 37 of the lenses 16 plus the thickness of the projections 27 on the spacer 13. There is thus defined a long continuous recess or enclosure for the lower parts of the lenses, — that is the projections 37, and the spacer and PCB.

The spacer and PCB are assembled to the bezel as follows. The lenses 16 are pushed into the apertures 18 from below, being held in position frictionally by a slight wedging action as described above. A bar 42 of the bezel 17 extends between each adjacent two lenses, as seen in FIG. 2. The assembled spacer 13 and PCB 12, with LEDs 15 in position and soldered to the circuit 20, is then presented to the lower part of the bezel, below apertures 18. The projections 27 on the spacer 13 pass through the slots 46 in the flange 45 on the bezel and the protrusions 43 on the bezel pass through the slots 29 in the flange 28 on the spacer 13.

Once the spacer is positioned, with projections 27 through slots 46 and protrusions 43 through slots 29, lateral movement of the spacer 13 locks the spacer, PCB, LED subassembly in position in the bezel. As viewed in FIGS. 10 and 11, the lateral movement is to the left. To provide positive positioning or locking, of the spacer and PCB in the final assembled position suitable detents or similar features are provided. Thus for example, as seen in FIG. 2, small ribs or protrusions 50 can be formed on the upper surface of the spacer to clip into place between the bottoms of adjacent webs 36 on the lenses 16. To provide for release of the spacer/PCB subassembly, a recess 51 is formed at the end of the bezel in which a screwdriver or other tool can be inserted and slightly twisted to push the spacer laterally and release it, for eventual withdrawal.

Typically, the spacer 13, is in black plastic, as is also the bezel 17. The pushbuttons 11 are clear plastic and the lenses 17 in red transparent plastic. The bars 42 of the bezel, separating the lenses 16, are in alignment with bars 53 separating adjacent pushbuttons and thus providing good visual association between the lenses and related pushbutton. This good visual association between lenses and related pushbuttons, giving a strong visual link between any given function key and the associated LED is important. An LED has a relatively low light output and as many as fifty key/LED combinations could occur in a single piece of equipment, operator confusion could be a problem unless the information is presented to the operator as clearly as possible.

It occurs that with certain types of system for which the present array is intended, that certain keys — or pushbuttons — change their function to suit user requirements, and, on occasion change to a function which should not have an associated LED, that is no lighted indicator. Such changes are arbitrary and cannot be anticipated and therefore cannot be provided during manufacture. It is impracticable to remove or disconnect an LED in the field. Further even with a disconnected LED, the presence of a lens suggests the presence of an aperture LED.

With the assembly of the present invention, it is possible to replace a red lens with a black opaque replica. This is done by removing the spacer/PCB/LED subassembly, taking out the pair of lenses containing the lens to be replaced, breaking the pair of lenses apart and replacing the one red lens, and putting in a single black opaque lens at the required position. The spacer/PCB/LED subassembly is then replaced. There is also provided the ready repair in the event that an LED should fail. The complete assembly of PCB 12, spacer 13, LEDs 15, lenses 16 and bezel 17 can be quickly and easily disconnected from the electronics of a system — by a single plug — and replaced in the field with minimum effort and minimal down time of the equipment. The key assembly is unaffected. Alternatively just a subassembly of PCB, spacer and LEDs need be replaced.

The form of assembly can be used for a lighted display of more than one row of LEDs and bezel with multiple rows of lenses. FIGS. 14, 15 and 16 and 17 are views similar to those of FIGS. 10, 11, 12 and 13, for a bezel 55 which has one row of apertures 19 for pushbuttons, one row of apertures 18 on one side for LEDs and associated lenses and two rows of apertures 18 on the other side, also for LEDs and associated lenses. The form of the bezel 55 on the side of the one row of apertures 18 is the same as in the bezel 17 for the two of lenses and LEDs, and a single row subassembly of PCB 12, spacer 13, LEDs 15 as in FIGS. 1 and 2, and FIGS. 3 and 4 is used. For the two rows of apertures 18 a wider subassembly of PCB and spacer with two rows of LEDs is used. Pairs of lenses 16 are used, as in FIGS. 1, 2, 8 and 9. Assembly of the PCB/spacer/LEDs, and lenses, is the same as for the single row, with projection on one side of the spacer, slots in a flange on the other side of the spacer, slots in a flange on one side of the opening in the bezel and protrusions on the other side. The slots in the flange and protrusions of the bezel are indicated in FIGS. 15, 16 and 17 at 43*a*, 45*a* and 46*a*.

Single lenses can be replaced in the double row as in the single row.

The invention provides an LED indicator assembly which is versatile, easy and economical to produce and is easy to assemble and install. The ability to eliminate an LED indicator at any pushbutton position, without interfering with the LED itself, or the associated circuitry, is advantageous. The assembly can be used for various forms and types of apparatus and is economically suitable for such varied use as the provision of special features, such as changing of a lens from transparent to opaque, does not increase the manufacturing cost, or cause increased complicity.

What is claimed is:

1. A light emitting diode indicator assembly for a multiple pushbutton array comprising:

an elongate printed circuit board having a plurality of circuits thereon and a plurality of connection positions to said circuits spaced along said board;

an elongate electrically insulating spacer attached to one surface of said printed circuit board, said spacer including a plurality of locations for a plurality of light emitting diodes, a diode at each location, said location each associated with a related connection position on said printed circuit board;

a light emitting diode inserted at each of said locations, each diode including leads passing through said spacer and electrically connected to the related circuit at the related connection position;

a plurality of lenses positioned over said light emitting diodes, a lens over each diode;

a bezel having a plurality of first apertures extending in a line and a lens positioned in each of said first apertures, and a plurality of second apertures extending in a line alongside said first apertures, each second aperture in lateral alignment with a related first aperture, said second apertures for reception of a pushbutton key in each of said second apertures;

said bezel including a longitudinally extending wall and a longitudinally extending web, said wall and web spaced apart to define a recess beneath said first apertures for the reception of said spacer;

interengaging formations on said wall and web of said bezel and on side edges of said spacer, said formations arranges such that when the spacer is inserted in said recess and moved longitudinally, the formations interengage to retain said spacer in said recess.

2. An assembly as claimed in claim 1, said lenses in pairs and of transparent material.

3. An assembly as claimed in claim 2 at least one of said pairs of lenses removed and replaced by two single lenses, at least one of the single lenses of opaque material.

4. An assembly as claimed in claim 1, said interengaging formations comprising: an inwardly extending flange at a lower edge of said wall, a series of slots in said flange, and a series of projections on the related side edge of said spacer, said projections entered through said slots; a series of inwardly extending projections at a lower edge of said web, a laterally extending flange on the related side edge of said spacer, and a series of slots in said laterally extending flange, said projections on said web entered through said slots in said laterally extending flange;

said longitudinal movement at said spacer engaging said projections with said flanges.

5. An assembly as claimed in claim 1, including at least one further plurality of first apertures extending in a line alongside said line of first apertures; a lens positioned in each further first aperture and an LED positioned beneath each of said lenses in said further first apertures.

* * * * *